United States Patent [19]

Marshall, Jr. et al.

[11] 4,420,826

[45] Dec. 13, 1983

[54] STRESS RELIEF FOR FLEXTENSIONAL TRANSDUCER

[75] Inventors: William J. Marshall, Jr., Nashua; Ronald P. White, Amherst, both of N.H.

[73] Assignee: Sanders Associates, Inc., Nashua, N.H.

[21] Appl. No.: 280,637

[22] Filed: Jul. 6, 1981

[51] Int. Cl.[3] ..... H04R 17/00

[52] U.S. Cl. ..... 367/167; 367/155; 367/159; 367/172; 310/337

[58] Field of Search ..... 310/337, 345; 181/110, 181/120; 367/140, 141, 142, 149, 153–157, 159, 163, 165, 167, 111, 172, 174

[56] References Cited

U.S. PATENT DOCUMENTS

| | | | |
|---|---|---|---|
| 3,241,099 | 3/1966 | Elston et al. | 367/167 |
| 3,258,738 | 6/1966 | Merchant | 367/163 |
| 3,274,537 | 9/1966 | Toulis | 367/155 |
| 3,277,433 | 10/1966 | Toulis | 367/155 |
| 3,749,948 | 7/1973 | Morris | 367/165 |
| 3,813,744 | 6/1974 | Morris | 367/166 |

*Primary Examiner*—Harold J. Tudor

*Attorney, Agent, or Firm*—Louis Etlinger; Donald A. Streck

[57] ABSTRACT

This invention is a device that permits a flextensional transducer to function after the flextensional transducer experiences a pressure equal to or greater than the pressure found at the survival depth of prior art flextensional transducers. The foregoing is achieved by not bonding at least one end of the transducer's piezoelectric stack to the transducer's shell and having the other end or ends of the piezoelectric stack held in the vicinity of the transducer's shell by a pair of guide rails, etc. This permits the transducer's shell to move away from at least one end of the piezoelectric stack at pressures equal to or greater than the pressure at which the stack would experience tensile stresses in a conventional flextensional design. Thus, the piezoelectric stack will not fracture since it receives no tensile stress. Hence, when the transducer experiences a hydrostatic pressure less than the pressure at the survival depth, the shell of the transducer will recontact the free end of the piezoelectric stack permitting the transducer to function.

5 Claims, 6 Drawing Figures

STRESS RELIEF FOR FLEXTENSIONAL TRANSDUCER

FIELD OF THE INVENTION

This invention relates to underwater acoustic systems and, more particularly, to flextensional transducers that utilize piezoelectric ceramic stacks to generate underwater sound.

BACKGROUND OF THE INVENTION

Underwater sound transducers are devices that detect or generate sound in water to determine the location of objects in the water. The transducer converts electrical energy into acoustic energy or acoustic energy into electrical energy.

One type of transducer utilized by the prior art was a flextensional transducer. Flextensional transducers have wider bandwidths, lower operating frequencies and higher power handling capabilities than other types of transducers of comparable size. A flextensional transducer has a flexible outer shell or housing which is excited by one or more interior piezoelectric ceramic stacks. The piezoelectric stacks are driven in a length expander mode and are placed in compression between opposing interior walls of the shell. The elongation and contraction of the piezoelectric stacks impart a motion to the shell which, in general, radiates or couples energy into the water.

The piezoelectric properties of ceramic transducers vary with the stress experienced by the transducer's piezoelectric stack. Stress is supplied to the piezoelectric stack by the transducer's shell. During assembly of the transducer, a static, compressive prestress is applied to the piezoelectric stack. As the depth of the transducer increases, the transducer's shell experiences increased hydrostatic pressure which causes increased shell deflection. This results in a decrease in the amount of stress that is applied to the piezoelectric stack. Thus, the characteristics of the transducer are variable with depth and, in general, the maximum depth of operation of the piezoelectrically-driven flextensional transducer is governed by the amount of ceramic stress that may be removed from the piezoelectric stack without affecting its performance. For purposes of this discussion, the survival depth of the transducer is that ocean depth in which the piezoelectric stack fractures due to increased tensile stress.

Prior art flextensional transducers could operate at full power at some ocean depths; at reduced power at greater ocean depths (maximum operating depth) and at still greater ocean depths the transducer's piezoelectric stack would fracture and the transducer would not operate at all. Thus, if the flextensional transducer accidently descended beyond its survival depth and subsequently was raised to its maximum operating depth, the transducer would not function. In order to increase the survival depth of the transducer, the prior art would change the design of the transducer by increasing the thickness of the walls of the transducer and/or the size of the transducer. A disadvantage of the foregoing was that the modified transducer would resonate at a different frequency than the originally designed transducer. Thus, a trade-off had to be made between the survival depth of the transducer and the transducer's resonant frequency.

SUMMARY OF THE INVENTION

This invention overcomes the disadvantages of the prior art by providing a flextensional transducer that may descend below the survival depth of the transducer without fracturing the transducer's piezoelectric stacks. Hence, when the transducer is raised to its maximum operating depth, the transducer will be able to function since all of its component parts will still be in operating order.

The apparatus of this invention achieves the foregoing by preventing the piezoelectric ceramic stack from experiencing tensile stress at high hydrostatic pressures. The piezoelectric stack will not receive any tensile stress since both ends of the piezoelectric stack are not bonded to the shell. Thus, at increased hydrostatic pressures the piezoelectric stack will pull away from the transducer's shell as the shell continues to deform so that the piezoelectric stack will not be subjected to any tensile stress. The foregoing is accomplished without changing the operating characteristics of the transducer.

It is an object of this invention to provide a flextensional transducer that may survive ocean depths greater than its survival depth.

Other objects and advantages of this invention will become more apparent as the following description proceeds, which description should be considered in conjunction with the accompanying drawings.

DESCRIPTION OF A PREFERRED EMBODIMENT

Figure 1:
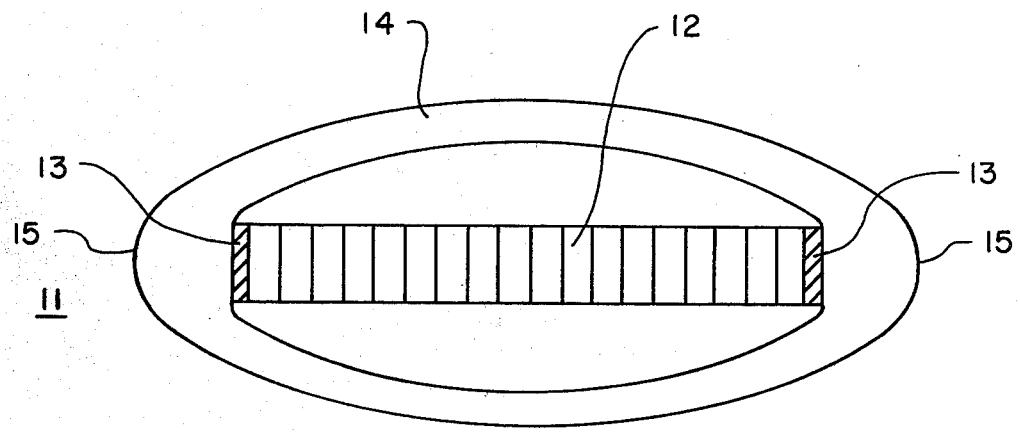
PRIOR ART FIG. 1
FIG. 1 is a top view of a prior art flextensional transducer.

Referring now to the drawings in detail and more particularly to FIG. 1, the reference character 11 designates a flextensional transducer that was utilized in the prior art. Both ends of piezoelectric ceramic stack 12 are connected to insulators 13. In order to insert stack 12 and material 13 within transducer 11, the walls 14 of transducer 11 are placed in a hydraulic press and a force is applied to walls 14. The aforementioned force causes the distance between ends 15 to increase, allowing insertion of at least one stack 12 and material 13. Before insertion of stack 12 and material 13, the ends of material 13 are coated with epoxy. After stack 12 and material 13 is inserted within transducer 11 the force is removed from walls 14 allowing shell ends 15 to compress or preload stack 12. The top and bottom ends of transducer 11 are then sealed with end covers and a rubber boot (not shown) to prevent flooding of the interior of transducer 11.

Figure 2:
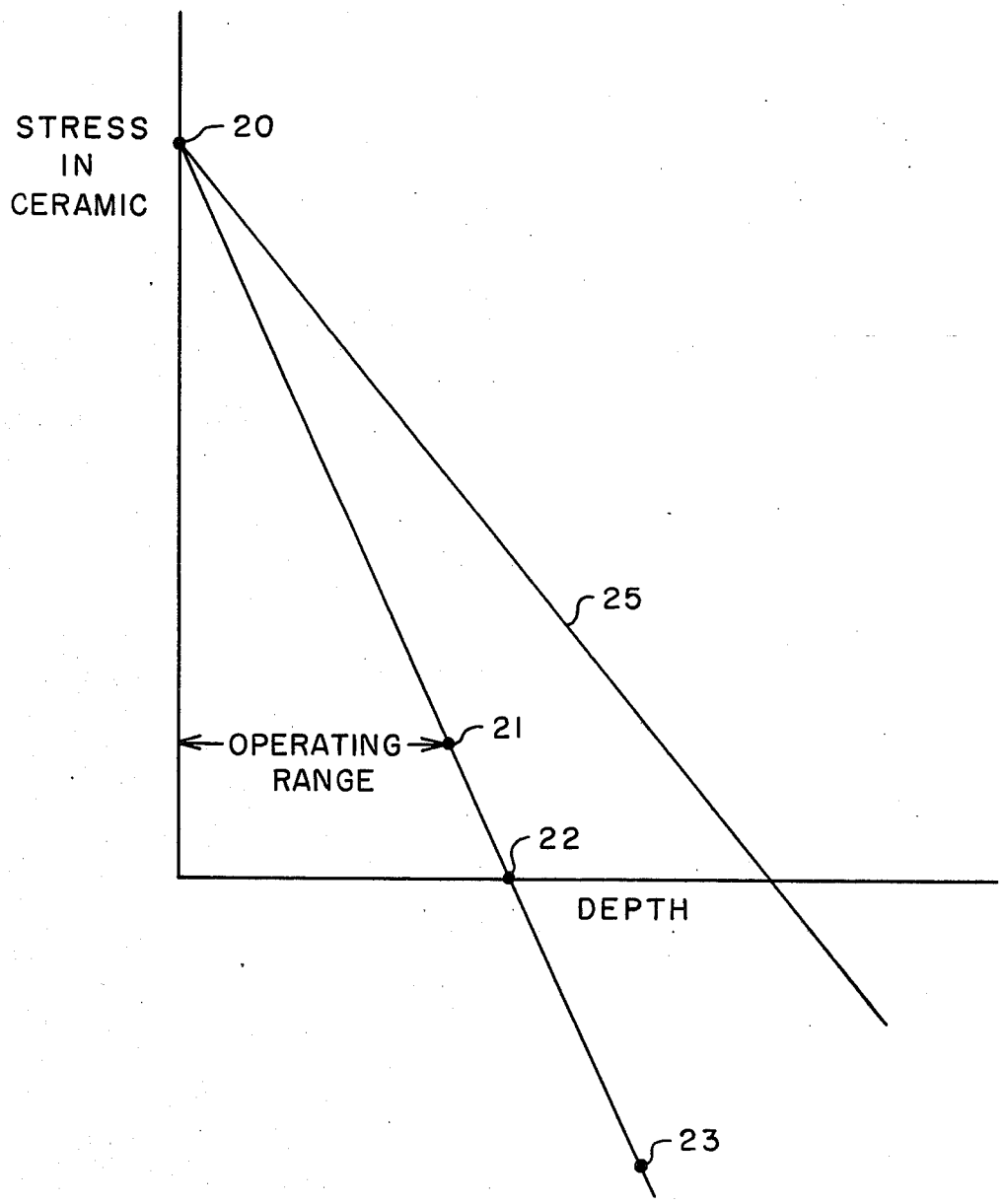
FIG. 2 is a graph of a depth vs. stress curve for typical piezoelectric ceramic stacks.

FIG. 2 is a depth vs. stress curve for particular piezoelectric stacks. At zero depth or at the surface of the water, there is a certain stress 20 in the piezoelectric ceramic stack. This stress is called ceramic prestress. The amount of ceramic prestress is determined by how much prestress was built into the stack (only a certain amount of prestress may be built into the stack, too much prestress would harm the stack) and the preload received by the stack. As the piezoelectric stack slowly descends in the water, the stress on the stack decreases. In order to operate a transducer one needs a certain amount of residual stress in the stack. The amount of residual stress required is represented by point 21. As long as the net amount of stress in the stack is equal to or greater than the residual stress, the transducer may operate at full power. Thus, the operating range of the transducer is between 20 and 21. Beyond the aforementioned depth the amount of stress remaining in the piezoelectric stack is insufficient to permit full power operation of the transducer. However, between point 21 and slightly before point 22 the transducer may operate at reduced power. At point 22 and beyond there is no stress on the piezoelectric stack. Thus, if the prior art piezoelectric stacks descended beyond point 22 towards point 23, the piezoelectric stack would be placed in tension by the high hydrostatic pressure that is applied to the shell of the transducer. This tension will cause the piezoelectric stack to fracture. Thus, point 22 will be called the survival depth of the stack.

Different flextensional transducers will have different maximum operating and survival depths. The operating and survival depth of the transducer is a function of the size of the transducer, i.e., a thin-walled transducer with a small stack would represent the curve that passes through points 20, 21, 22 and 23. In order to increase the survival depth of the prior art flextensional transducers, the transducers would usually be made larger and the slope vs. depth curve would decrease. The above depth vs. stress curve may be represented by curve 25. Thus, for a particular size prior art flextensional transducer there is a specific depth dependency vs. stress curve.

At certain depths shock waves may cause flextensional transducers to malfunction. Shock waves are ocean disturbances that add pressure to the transducer shell and effectively increase the depth of the transducer. Thus, shock waves may cause a piezoelectric stack to fracture before the transducer has reached its survival depth. In the event one wanted to increase the survival depth of the transducer or permit the transducer to function after being exposed to shock waves one would change the size of the transducer. Changing the transducer's size would alter the transducer's acoustic properties. The apparatus of this invention will have a greater survival depth and be able to withstand more powerful shock waves than prior art flextensional transducers, since both ends of the piezoelectric stack will not be bonded to the walls of the transducer shell. Hence, as the transducer descends below the prior art transducer's survival depth and as the transducer's shell continues to deform, the ends of the transducer's shell will pull away from the piezoelectric stack.

Figure 3:
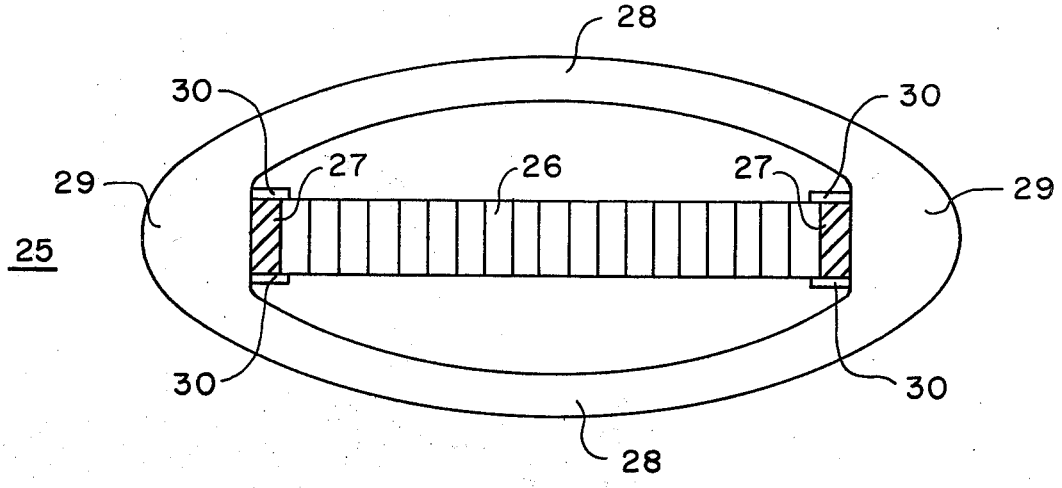
FIG. 3 is a top view of a piezoelectric ceramic stack being held next to the walls of a flextensional transducer by rubber dams.

FIG. 3 is a top view of flextensional transducer 25. Both ends of piezoelectric ceramic stack 26 are connected to an insulating material 27. At least one stack 26 together with material 27 is interposed between ends 29 by: placing the walls 28 of transducer 25 in a hydraulic press and applying a force to walls 28 to increase the distance between ends 29; inserting stack 26 and material 27 between ends 29, and removing the aforementioned force so that ends 29 will approach their original position.

Stack 26 and material 27 are held next to ends 29 by the pressure exerted on material 27 by ends 29. Elastic dams 30 are placed next to ends 29, material 27 and stack 26 to ensure that material 27 and stack 26 will not slide down transducer 25. Dams 30 may be any soft rubber-like material that stretches when it is installed, i.e., a caulking compound. Thus, stack 26 and material 27 are just held in the vicinity of ends 29, they are not bonded to ends 29. If transducer 25 would descend below the survival depth of the prior flextensional transducers, ends 29 would move away from material 27 and piezoelectric stack 26. Hence, stack 26 would not be exposed to any tensile stress and stack 26 would not fracture. Material 27 and stack 26 would just be held between ends 29 by dams 30. In the event transducer 25 was raised above the prior art survival depth, transducer 25 will be able to function. The reason for this is that stack 26 was not fractured and the lower hydrostatic pressure would cause walls 28 and ends 29 to move back to their original orientations so that stack 26 and material 27 will be next to ends 29. It is also possible to achieve the above result by having one end of material 27 and stack 26 bonded to end 29 and the other end of material 27 and stack 26 held in place by dams 30.

Figure 4:
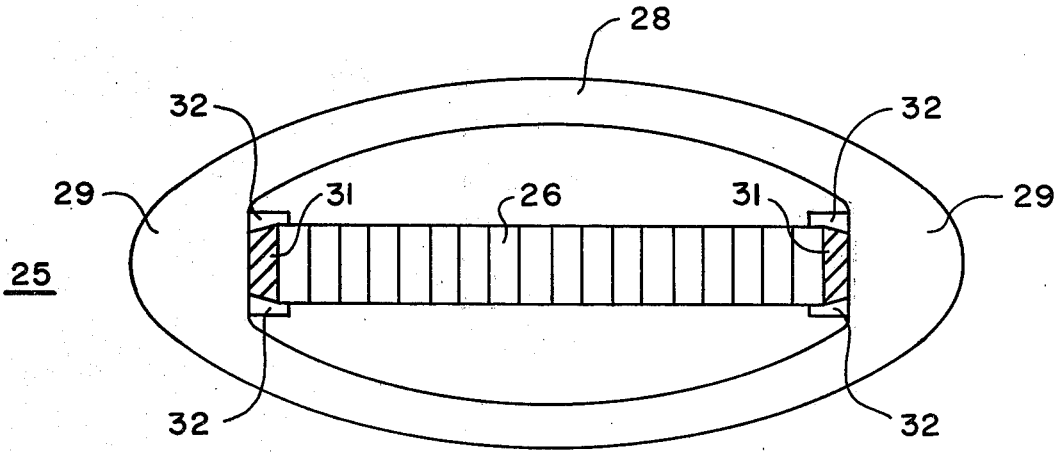
FIG. 4 is a top view of a piezoelectric ceramic stack being held next to the walls of a flextensional transducer by guide rails.

FIG. 4 is a top view of an alternate embodiment of this invention showing both ends of the piezoelectric stack of FIG. 3 bonded to insulating material 31. Insulating material 31 is tapered along its sides so that material 31 and piezoelectric stack 26 may slide along guide rails 32. Guide rails 32 are fastened to ends 29 of transducer 25 and stack 26 together with material 31 is inserted within rails 32 in the manner heretofore described in the description of FIG. 2.

Guide rails 32 ensure that material 31 and piezoelectric stack 26 is held in the vicinity of ends 29. Material 31 is not bonded to ends 29 or rails 32. Thus, if transducer 25 descended below the survival depth of prior art flextensional transducers, ends 29 would move away from piezoelectric stack 26 and material 31. Material 31 would slide along rails 32 away from ends 29 so that stack 26 will not experience any tensile stress. When transducer 25 is raised above the prior art survival depth, ends 29 will move towards material 31 causing material 31 to slide along rails 32 and be next to ends 29. Thus, transducer 25 will be able to function even though it descended below the prior art survival depth. It is also possible to achieve the foregoing result by having one end of material 31 and stack 26 bonded to end 29 and the other end of material 31 and stack 26 held in place by rails 32.

Figure 5:
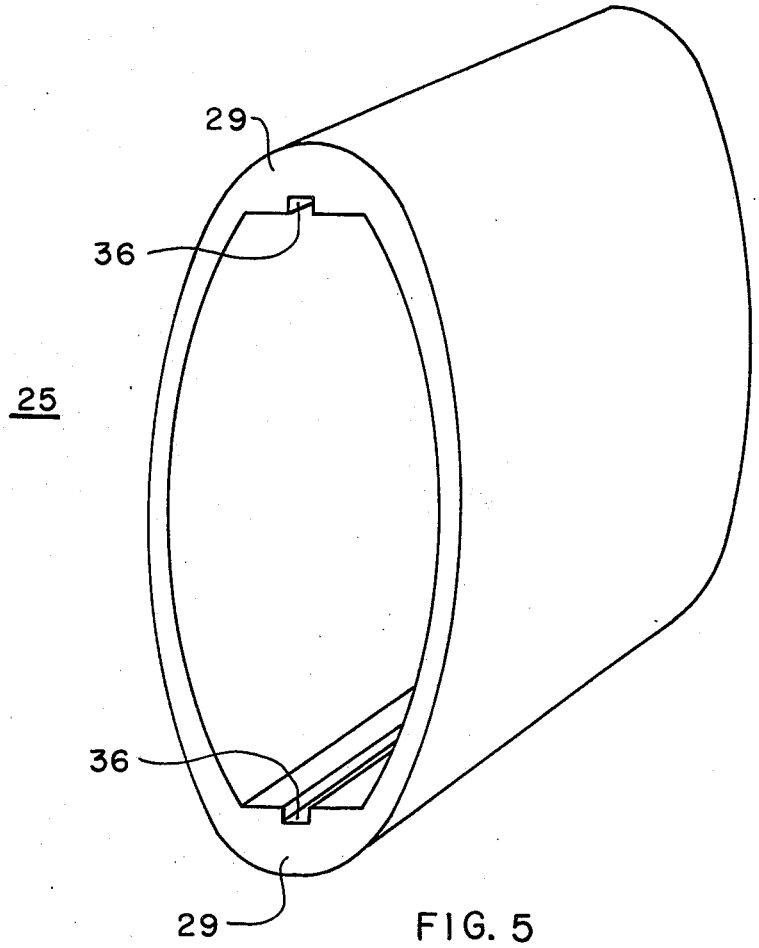
FIG. 5 is a perspective representation of a partially assembled flextensional transducer having a groove cut in two of its interior walls.
Figure 6:
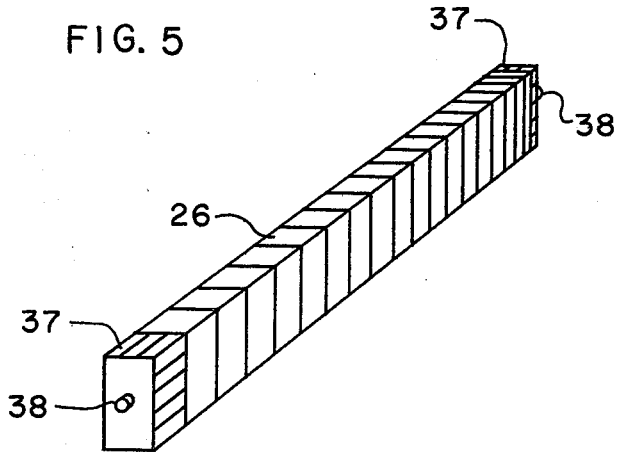
FIG. 6 is a perspective representation of the piezoelectric ceramic stack that will be placed in the grooves of FIG. 5.

FIGS. 5 and 6 are perspective representations of an alternate embodiment of flextensional transducer 25 which was previously depicted in FIGS. 3 and 4. Grooves 36 are cut into ends 29 and both ends of piezoelectric stack 26 are bonded to insulating materials 37. Pins are connected to material 37 so that when at least one stack 26 and material 37 are placed between ends 29 in the manner heretofore described, pins 38 will rest within grooves 36. Grooves 36 and pins 38 ensure that material 37 and stack 26 are held in the vicinity of ends 29. Material 37 and pins 38 are not bonded to ends 29. In the event transducer 25 experiences a pressure equal to or greater than that experienced by prior art flextensional transducers experienced at or below their survival depth, stack 26 will not fracture. The reason for this is that material 37 and stack 26 will move away from ends 29 and stack 26 will not be exposed to any tensile stress. Pins 38 will keep material 37 and stack 26 aligned within grooves 36 so that when transducer 25 returned to a pressure at which transducer 25 is able to function, ends 29 will move next to material 37 and stack 26. Hence, transducer 25 will be able to function even though it experienced a pressure greater than the pressure that exists below the survival depth of prior art flextensional transducers. The aforementioned result may also be achieved by having one end of material 37 and stack 26 bonded to end 29 and the other end of material 37 and stack 26 held within groove 36 by pin 38.

The above specification describes a new and improved flextensional transducer that utilizes piezoelectric ceramic stacks as driving elements to move the transducer shell. It is realized that the above description may indicate to those skilled in the art additional ways in which the principles of this invention may be used without departing from its spirit. It is, therefore, intended that this invention be limited only by the scope of the appended claims.

We claim:

1. In an underwater flextensional acoustical transducer comprising a cylindrical shell with an extendable driver stack disposed in an operable position between opposed sides of the shell in a longitudinally prestressed state, the improvement to prevent damage to the driver stack from negative stress resulting from overpressurization of the transducer comprising:

(a) one of the ends of the driver stack being adapted to move longitudinally away from its respective side of the shell during an overpressurization condition of the transducer; and (b) guide means operably disposed adjacent said end and its respective side for guiding said end back into its operable position as said overpressurization condition is removed.

2. The improvement of claim 1 wherein said guide means comprises:

a pin on one of the two members and a groove on the other adapted to receive said pin in a sliding relationship.

3. The improvement of claim 1 wherein said guide means comprises:

guide rails carried by the shell extending along the driver adjacent said end.

4. The improvement of claim 3 wherein:

said end and said guide rails are tapered inwardly.

5. The improvement of claim 1 wherein said guide means comprises:

an elastic calking material having a soft rubber-like quality disposed adjacent said end and its respective side.

* * * * *